US008552913B2

(12) United States Patent
Ayatollahi et al.

(10) Patent No.: US 8,552,913 B2
(45) **Date of Patent: *Oct. 8, 2013**

(54) HIGH ISOLATION MULTIPLE PORT ANTENNA ARRAY HANDHELD MOBILE COMMUNICATION DEVICES

(75) Inventors: Mina Ayatollahi, Waterloo (CA); Qinjiang Rao, Waterloo (CA)

(73) Assignee: BlackBerry Limited, Waterloo (CA)

( * ) Notice: Subject to any disclaimer, the term of this patent is extended or adjusted under 35 U.S.C. 154(b) by 347 days.

This patent is subject to a terminal disclaimer.

(21) Appl. No.: 12/776,678

(22) Filed: May 10, 2010

(65) Prior Publication Data

US 2010/0238079 A1 Sep. 23, 2010

Related U.S. Application Data

(63) Continuation-in-part of application No. 12/405,955, filed on Mar. 17, 2009, now Pat. No. 8,085,202.

(51) Int. Cl.
*H01Q 1/24* (2006.01)

(52) U.S. Cl.
USPC ..... 343/702; 343/770

(58) Field of Classification Search
USPC ..... 343/702, 770, 767, 725, 729, 893
See application file for complete search history.

(56) References Cited

U.S. PATENT DOCUMENTS 5,547,100 A 8/1996 Johnson
5,633,646 A 5/1997 Strickland
5,754,143 A 5/1998 Warnagiris et al.
6,075,493 A 6/2000 Sugawara et al.
6,313,798 B1 11/2001 Bancroft et al.
6,593,887 B2 7/2003 Luk et al.
6,791,498 B2 9/2004 Boyle et al.
6,950,071 B2 9/2005 Wen et al.
7,023,387 B2 4/2006 Wen et al.
7,038,627 B2 5/2006 Ikuta et al.
7,283,097 B2 10/2007 Wen et al.

(Continued)

FOREIGN PATENT DOCUMENTS

EP 1077505 A2 2/2001
EP 1162688 A1 12/2001

(Continued)

OTHER PUBLICATIONS

International Search Report and Written Opinion for Application No. PCT/CA2011/050284, Aug. 3, 2011.

(Continued)

*Primary Examiner* — Hoanganh Le
(74) *Attorney, Agent, or Firm* — Moffat & Co.; Timothy Clise; Joseph Ulvr

(57) ABSTRACT

A multiple input-multiple output antenna assembly with high isolation between the antennas is disclosed. The antenna assembly includes a substrate with a ground layer at its surface. Two antennas are disposed opposing each other on the substrate. A meandering slot is interposed between the first and second antennas on the ground plane. A first signal port is provided for applying a first signal to excite the first antenna and a second signal port is provided for applying a second signal to excite the second antenna. The meandering slot provides isolation that inhibits electromagnetic propagation between the first and second antennas. A third signal port is provided for applying a third signal to excite the meandering slot to act as another antenna for multiple input, multiple output operation.

29 Claims, 5 Drawing Sheets

(56) References Cited

U.S. PATENT DOCUMENTS

| | | | | |
|---|---|---|---|---|
| 7,352,327 | B2 | 4/2008 | Yeh et al. | |
| 7,352,328 | B2 | 4/2008 | Moon et al. | |
| 7,369,089 | B2 | 5/2008 | Wen et al. | |
| 7,400,300 | B2 | 7/2008 | Qi et al. | |
| 7,403,165 | B2 | 7/2008 | Qi et al. | |
| 7,629,930 | B2 | 12/2009 | Murch et al. | |
| 7,701,395 | B2 | 4/2010 | Alvey et al. | |
| 8,085,202 | B2 * | 12/2011 | Ayatollahi et al. | 343/700 MS |
| 2004/0085245 | A1 | 5/2004 | Miyata et al. | |
| 2007/0001911 | A1 | 1/2007 | Fujio et al. | |
| 2007/0109204 | A1 | 5/2007 | Phillips et al. | |
| 2008/0062058 | A1 | 3/2008 | Bishop | |
| 2008/0231530 | A1 | 9/2008 | Rao et al. | |
| 2008/0284661 | A1 | 11/2008 | He | |
| 2008/0287171 | A1 | 11/2008 | Qi et al. | |
| 2009/0262028 | A1 * | 10/2009 | Mumbru et al. | 343/702 |
| 2009/0273529 | A1 | 11/2009 | Liu | |
| 2010/0207835 | A1 * | 8/2010 | Taura | 343/770 |
| 2010/0225544 | A1 * | 9/2010 | Taura | 343/702 |

FOREIGN PATENT DOCUMENTS

| | | | |
|---|---|---|---|
| JP | 20080167393 | | 7/2008 |
| WO | 03058759 | A1 | 7/2003 |
| WO | 03096475 | A1 | 11/2003 |
| WO | 2004015810 | A1 | 2/2004 |
| WO | 2008001169 | A2 | 1/2008 |
| WO | 2008049354 | A1 | 5/2008 |
| WO | WO2010036955 | A1 | 4/2010 |

OTHER PUBLICATIONS

Examination Report for EP Application No. 10156819.4 dated Apr. 13, 2011.

Waldschmidt and Wiesbeck; Compact Wide-Band Multimode Antennas for MIMO and Diversity; IEEE Transactions on Antennas and Propagation; vol. 52, No. 8, Aug. 2004.

Svantesson; Correlation and Channel Capacity of MIMO Systems Employing Multimode Antennas; IEEE Transactions on Vehicular Technology, vol. 51, No. 6, Nov. 2002.

Forenza and Heath; Benefit of Pattern Diversity via Two-Element Array of Circular Patch Antennas in Indoor Clustered MIMO Channels; IEEE Transactions on Communications, vol. 54, No. 5, May 2006.

Vaughan; Two-Port Higher Mode Circular Microstrip Antennas; IEEE Transactions on Antennas and Propagation, vol. 36, No. 3, Mar. 1988.

M. Karaboikis, et al.; Compact Dual-Printed Inverted-F Antenna Diversity Systems for Portable Wireless Devices; IEEE Antenna and Wireless Propagation Letters, vol. 3, pp. 9-14, 2004.

H.-T. Chou, et al.; Investigations of Isolation Improvement Techniques for Multiple Input Multiple Output (MIMO) WLAN Portable Terminal Applications; Progress in Electromagnetics Research; PIER 85, pp. 349-366, 2008.

Ki-Jin Kim, et al.; High Isolation Internal Dual-Band Planar Inverted-F Antenna Diversity System with Band-Notched Slots for MIMO Terminals; 36th European Microwave Conference; pp. 1414-1417; Sep. 10-15, 2006.

Hsieh, C.P., et al.; Band-stop Filter Design of Coplanar Stripline; Asia-Pacific Microwave Conference 2007; Dec. 11, 2007; IEEE; Piscataway, NJ, USA; pp. 1-4.

Qinjiang Rao, et al.; Compact Low Coupling Dual—Antennas for MIMO Applications in Handheld Devices; Antennas and Propagation Society International Symposium, Jun. 1, 2009; pp. 1-4.

Ki-Jin Kim, et al.; The High Isolation Dual-Band Inverted F Antenna Diversity System with the Small N-Section Resonators on the Ground Plane; Asia-Pacific Microwave Conference 2006; Dec. 1, 2006; pp. 195-198.

European Patent Office Search Report in Application 10156819.4-2220, corresponding to subject U.S. patent application.

European Search Report, Application No. 10167565.0, Sep. 30, 2010.

* cited by examiner

HIGH ISOLATION MULTIPLE PORT ANTENNA ARRAY HANDHELD MOBILE COMMUNICATION DEVICES

CROSS-REFERENCE TO RELATED APPLICATIONS

This application is a continuation in part of U.S. patent application Ser. No. 12/405,955 filed on Mar. 17, 2009 now U.S. Pat. No. 8,085,202.

STATEMENT REGARDING FEDERALLY SPONSORED RESEARCH OR DEVELOPMENT

Not Applicable

BACKGROUND

The present invention relates generally to antennas for handheld, wireless communication devices, and more particularly to multiple-input, multiple-output antennas.

Different types of wireless mobile communication devices, such as personal digital assistants, cellular telephones, and wireless two-way email communication equipment are available. Many of these devices are intended to be easily carried on the person of a user, often compact enough to fit in a shirt or coat pocket.

As the use of wireless communication equipment continues to increase dramatically, a need exists provide increased system capacity. One technique for improving the capacity is to provide uncorrelated propagation paths using Multiple Input, Multiple Output (MIMO) systems. MIMO employs a number of separate independent signal paths, for example by means of several transmitting and receiving antennas.

MIMO systems, employing multiple antennas at both the transmitter and receiver offer increased capacity and enhanced performance for communication systems without the need for increased transmission power or bandwidth. The limited space in the enclosure of the mobile communication device, however presents several challenges when designing such antennas. An antenna should be compact to occupy minimal space and its location is critical to minimize performance degradation due to electromagnetic interference. Bandwidth is another consideration that the antenna designers face in multiple antenna systems.

Furthermore, since the multiple antennas are located close to each other, strong mutual coupling occurs between their elements, which distorts the radiation patterns of the antennas and degrades system performance, often causing an antenna element to radiate an unwanted signal. Therefore, minimal coupling between antennas in MIMO antenna arrays is preferred to increase system efficiency and battery life, and improve received signal quality.

Therefore, is it desirable to develop a MIMO antenna arrangement which has a compact size to fit within a device housing that is small enough to be attractive to consumers and which has improved performance.

DETAILED DESCRIPTION

Figure 1:
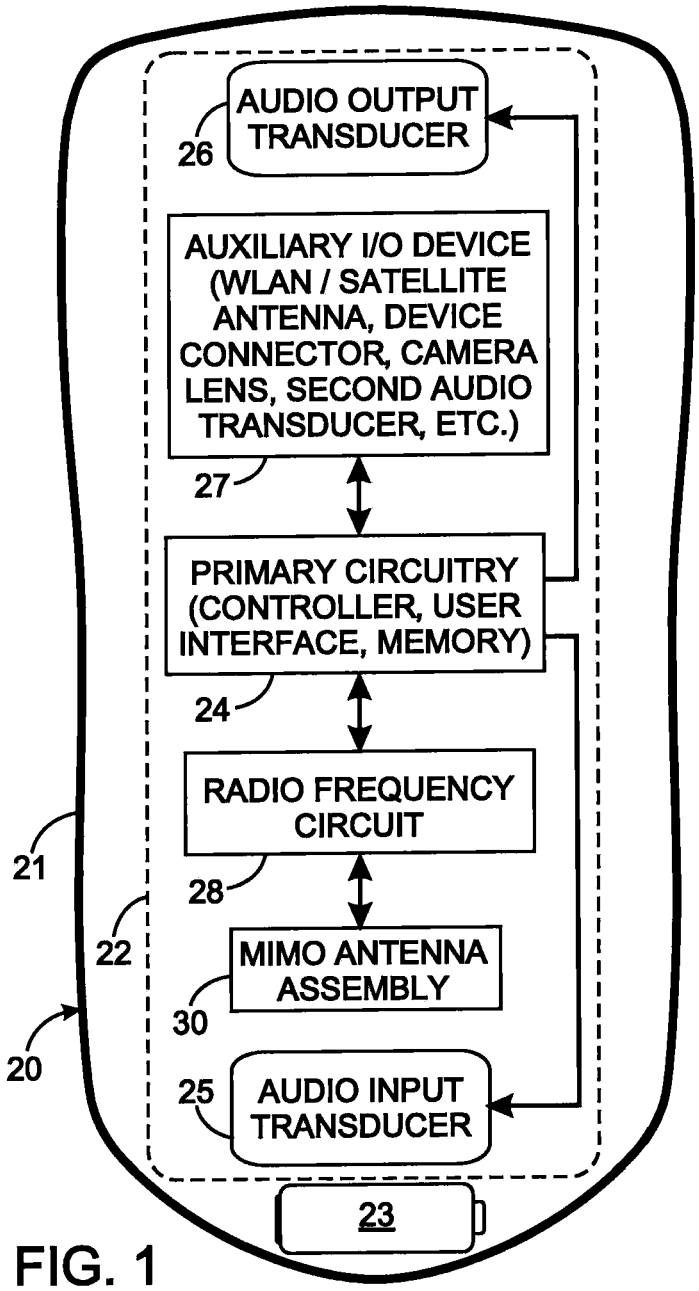
FIG. 1 is a schematic block diagram of a mobile wireless communication device that incorporates a MIMO antenna arrangement.

The present multiple port antenna assembly for use in multiple antenna systems, such as MIMO communication devices, provide isolation between two ports in a wide bandwidth, for example covering 2.25-2.8 GHz and supporting multiple communication standards. The exemplary antenna assembly has a pair of radiating elements, which, in the illustrated embodiments, comprise slot antennas, inverted F antennas, and patch antennas. It should be understood, however, that alternative radiating element types may be used, such as patch, planar inverted F (PIFA), monopole and other antenna types. The illustrated slot antennas are formed by creating two straight, open-ended slots at two opposing side edges of a conducting layer etched at one side of a printed circuit board (PCB), to form a pair of quarter wavelength slot antennas. The slots are located along one edge of the PCB opposing each other, and symmetrically with respect to the center line of the PCB. The other side of the PCB is available for mounting other components of the communication device. Each slot antenna in this configuration operates as a quarter wavelength resonant structure, with a relatively wide bandwidth. It should be understood, however, that alternative orientations, dimensions, and shapes may be used. The dimensions of the slots, their shape and their location with respect to the any edge of the PCB can be adjusted to optimize the resonant frequency, bandwidth, impedance matching, directivity, and other antenna performance parameters. It should also be understood that a slot may penetrate through the substrate of a board, in addition to the conducting layer. In addition, loaded slots may be used, with resistive material either at an end or within a slot. Furthermore the slots may be designed as a reconfigurable antenna element, with the frequency of operation being dynamically controlled by a controlling unit. The controlling unit with switches can be used to effectively change the electrical length of the slots and consequently change the frequency of operation for different frequency bands of interest. In one implementation, controllable switches are used, for example, a microelectromechanical system (MEMS), which enables different operating frequencies to be obtained by opening or closing conductive bridges across the slot. Other types of switches such as a PIN diode switch, FET, NEMS, varactor diodes, among others can be used for this purpose.

Each slot has a port to which a signal is applied to excite the slot which causes the respective slot to act as a radiating element of the antenna.

A patterned slot is formed in the conducting layer of the PCB between the pair of slot antennas to provide isolation between the radiators, thereby minimizing electromagnetic propagation from one antenna element to the other antenna element. This is specifically achieved by isolating the currents from the antennas that are induced on the ground plane. The isolation element pattern may be symmetrical with respect to a center line between the two antenna elements, or may be non-symmetrical. The isolating slot of a preferred embodiment has a meandering pattern. In some embodiments, the meandering shape is a serpentine slot that winds alternately toward and away from each antenna. In some embodiments, the electrical length of the isolation element slot is about quarter of the wavelength of the operating frequency.

A third port is provided across the isolating slot so that the isolating slot can be excited and act as yet another radiating element.

Referring initially to FIG. 1, a mobile wireless communication device 20, such as a cellular telephone, illustratively includes a housing 21 that may be a static housing, for example, as opposed to a flip or sliding housing which are used in many cellular telephones. Nevertheless, those and other housing configurations also may be used. A battery 23 is carried within the housing 21 for supplying power to the internal components.

The housing 21 contains a main printed circuit board (PCB) 22 on which the primary circuitry 24 for communication device 20 is mounted. That primary circuitry 24, typically includes a microprocessor, one or more memory devices, along with a display and a keyboard that provide a user interface for controlling the communication device.

An audio input device, such as a microphone 25, and an audio output device, such as a speaker 26, function as an audio interface to the user and are connected to the primary circuitry 24.

Communication functions are performed through a radio frequency circuit 28 which includes a wireless signal receiver and a wireless signal transmitter that are connected to a multiple antenna assembly 30. The antenna assembly 30 may be carried within the lower portion of the housing 21 and will be described in greater detail herein.

The mobile wireless communication device 20 also may comprise one or auxiliary input/output devices 27, such as, for example, a WLAN (e.g., Bluetooth®, IEEE. 802.11) antenna and circuits for WLAN communication capabilities, and/or a satellite positioning system (e.g., GPS, Galileo, etc.) receiver and antenna to provide position location capabilities, as will be appreciated by those skilled in the art. Other examples of auxiliary I/O devices 27 include a second audio output transducer (e.g., a speaker for speakerphone operation), and a camera lens for providing digital camera capabilities, an electrical device connector (e.g., USB, headphone, secure digital (SD) or memory card, etc.).

Figure 2:
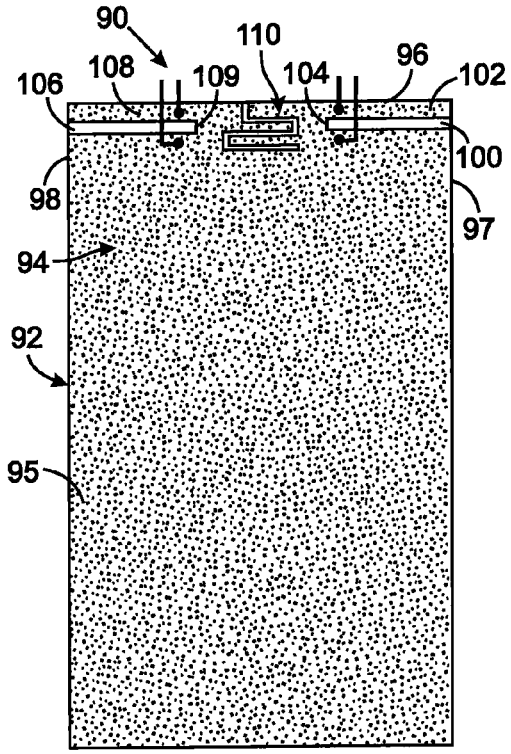
FIG. 2 is a plane view of a printed circuit board on which a version of a dual port antenna assembly is formed, wherein the antennas are slot antennas.
Figure 3:
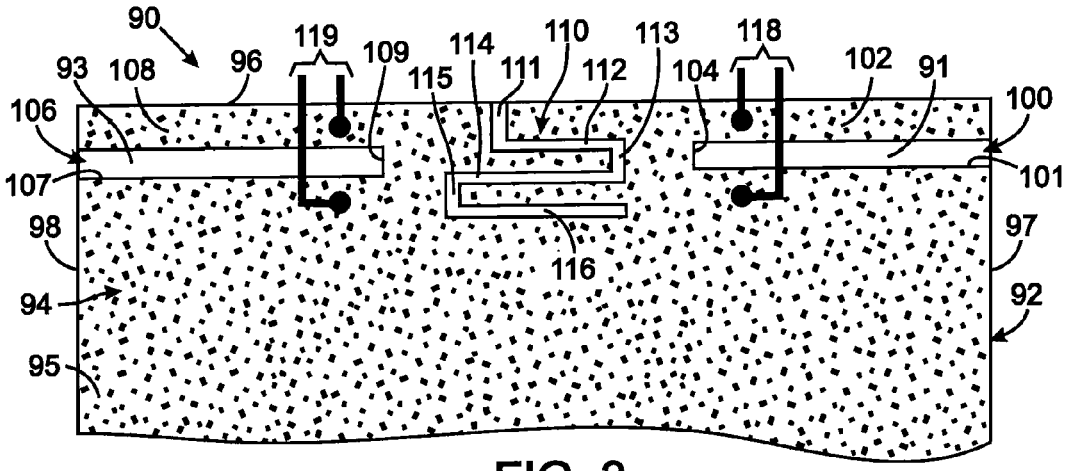
FIG. 3 is an enlarged view of a portion of the printed circuit board in FIG. 2.

With reference to FIGS. 2 and 3, a first antenna assembly 90 that may be used as the multiple antenna assembly 30 in the mobile wireless communication device 20. The first antenna assembly 90 is formed on a printed circuit board 92 that has a non-conductive, dielectric substrate 91, such as a dielectric material commonly used for printed circuit boards, with a major surface 93 on which a conductive layer 94, such as copper, is adhered to the major surface 93 to form a ground plane 95. The conductive layer can cover the entire major surface 93 as shown in FIGS. 2-7, or it can cover only part of the major surface 93 of the substrate. The ground plane 95 has a first edge 96 and second and third edges 97 and 98 that are orthogonal to the first edge. A first slot antenna 100 is formed by producing an open-ended first slot 101 entirely through the thickness of the conductive layer 94 and extending inwardly from the second edge 97 parallel to and spaced at some distance from the first edge 96. The first slot 101 terminates at an end 104. Similarly a second slot antenna 106 is formed by a second slot 107 extending inwardly from the third edge 98 parallel to and spaced from the first edge 96 and terminating at an inner end 109. In this embodiment, the slots of the two antenna 100 and 106 extend inward from an opposing edge of the ground plane and longitudinally parallel to a common edge 96 of the ground plane and thus are aligned parallel to each other. The two slots 101 and 107 form first and second radiating elements of the first and second slot antennas 100 and 106, respectively. The first and second slot antennas 100 and 106 oppose each other across a width of the ground plane 95 and may have substantially identical shapes.

The length of each of the slots 101 and 107, respectively forming the first and second slot antennas 100 and 106, is close to a quarter of a wavelength of the operating frequency. However, it should be understood that each antenna may have a different size than the other, in some embodiments. The width of the two conducting strips 102 and 108 affects the impedance bandwidth and the resonant frequency of the antennas. Those widths can be chosen so that a quarter wavelength resonance mode is excited on each of the first and second slot antennas 100 and 106. In some embodiments, the first and second antenna slots 101 and 107 lie on a common line. The two inner ends 104 and 109 of the first and second slots 101 and 107 are spaced apart by at least one-tenth of a smallest wavelength of a resonant frequency of the first and second radiating element, and are inward from the respective second and third edges 97 and 98 of the ground plane 95.

The ground plane 95 extends along three sides of the first and second slots 101 and 107. A first conducting strip 102 and a second conducting strip 108 are formed between the first edge 96 and the open-ended slots 101 and 107 respectively. The width of the conducting strips 102 and 108 can be adjusted to optimize antenna resonant frequency and bandwidth.

A first signal port 118 is provided by contacts on the ground plane 95 on opposite sides of the first slot antenna 100 near the inner end 104. A second signal port 119 is provided by other contacts on the ground plane 95 on opposite sides of the second slot 107 near its inner end 109. The first and second signal ports 118 and 119 are connected to the radio frequency circuit 28, which uses the first and second radiating elements to transmit and receive signals. That operation can have different modes in which only one of the two radiating elements, i.e. slots 101 and 107, is used to send or receive a signal. Alternatively, two separate excitation signals can be applied simultaneously, one signal to each of the slot antennas 100 and 106. At other times, different signals can be received simultaneously by each of the slot antennas 100 and 106.

The first and second slot antennas 100 and 106 are isolated from each other by a patterned slot cut in the conductive layer 94, between the radiating elements formed by slots 101 and 107. Specifically, an isolation slot 110 is located through the ground plane 95 between the first and second slot antennas 100 and 106 and specifically equidistantly between the inner ends 104 and 109 of the antennas. The isolation element 110 is in the form of an isolating slot that has a serpentine pattern which meanders winding back and forth as a serpentine between the two slot antennas 100 and 106 as the isolating slot progresses inward from the first edge 96. Specifically, the slot of isolation element 110 has a first leg 111 that extends orthogonally inward from the first edge 96, and has an inner end from which a second leg 112 extends parallel to the first edge and toward the first slot antenna 100. The second leg 112 terminates a distance from the first slot antenna 100 and a third leg 113 projects at a right angle from that end of the second leg 112 away from the first edge 96. The third leg 113 terminates at a point from which a fourth leg 114 extends parallel to the first edge 96 and toward the second slot antenna 106, terminating at a remote end. A fifth leg 115 extends at a right angle from that remote end of the fourth leg 114 orthogonally away from the first edge 96. The fifth leg 115 terminates at a point at which a sixth leg 116 extends parallel to the first edge 96 and toward the second edge 97 of the ground plane 95. The six legs 111-116 of the isolation slot 110 provide a meandering slot that winds back and forth between the two antenna slots 101 and 107. The electrical length of this isolation slot 110 can be approximately a quarter of a wavelength at the operating frequency.

This isolation slot 110 provides electrical separation between the two slot antennas 100 and 106. The width and length of each leg and the number of legs of the serpentine isolation slot 110 can be varied to optimize the isolation (i.e., minimize mutual coupling) between the two radiating elements of first antenna assembly 90, as well as the operating bandwidth. The antenna slots 101 and 107 and the isolation slot 110 extend entirely through the thickness of the conductive layer exposing portions of the first major surface 93 of the printed circuit board substrate. In addition, the meandering isolating slot increases the bandwidth of each radiating element by at least three times. By adjusting the length of the legs 111-116, the bandwidth and resonance frequency can be changed. More particularly, the bandwidth can be tuned by changing the length of the sixth leg 116.

Figure 4:
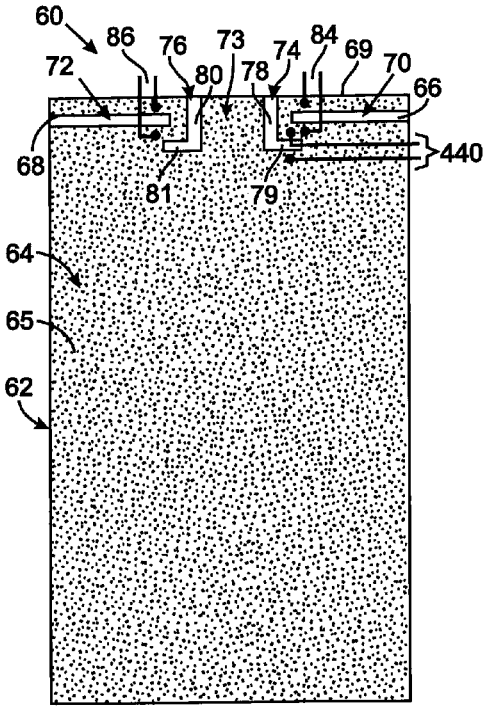
FIG. 4 is a plane view of a printed circuit board on which a second version of a two port antenna assembly is formed.

FIG. 4 illustrates a different slot pattern that provides the isolation. A second antenna assembly 60 also has a printed circuit board 62 with a major surface on which a layer 64 of conductive material is disposed to form the ground plane 65. The second antenna assembly 60 has a pair of open end slots 66 and 68 extending inward from opposite side edges of the ground plane and parallel to a first edge 69 of the ground plane. Each of the first and second slots 66 and 68 has a portion of the ground plane 65 on three sides. This antenna assembly has first and second signal ports 84 and 86 with excitation contacts for applying a first and a second signal, respectively, to the first and second antenna slots 66 and 68.

An isolation slot pattern 73 comprises first and second L-shaped isolation slots 74 and 76 each forming a meandering pattern. The first isolation slot 74 has a first leg 78 that extends inwardly from the first edge 69 of the ground plane 65. The first leg 78 extends inwardly beyond the first slot 66 terminating at an end from which a second leg 79 projects toward and parallel to the first slot. The second isolation slot 76 has a first leg 80 similarly extending inwardly through the conductive layer from the first edge 69. That first leg 80 extends beyond the second slot 68 terminating at an end from which a fourth leg projects toward and parallel to the second slot 68.

Figure 5:
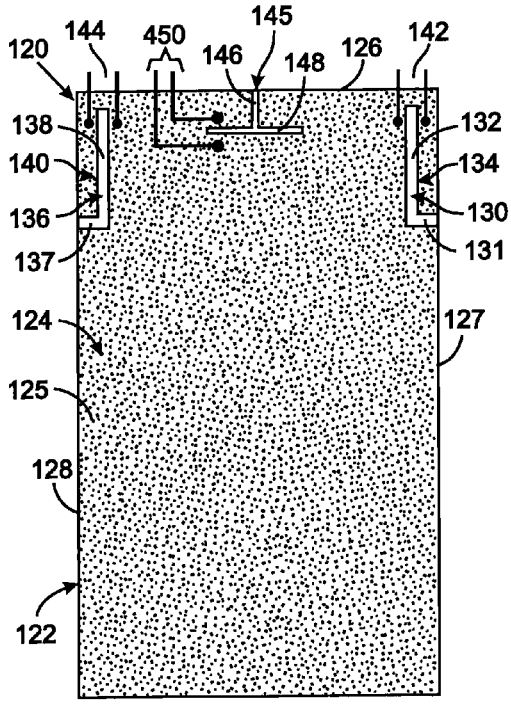
FIG. 5 is a plane view of a printed circuit board on which a third version of a two port antenna assembly is formed.

FIG. 5 depicts a third antenna assembly 120 formed on a printed circuit board 122 that has a major surface on which a layer 124 of conductive material, such as copper, is applied to form a ground plane 125. The ground plane has a first edge 126 and second and third edges 127 and 128 orthogonal to the first edge. A first antenna 134 has a radiating element that is defined by an open-ended first slot 130 having an L-shape with a short first leg 131 extending inwardly from and orthogonally to the second edge 127 terminating at an inner end. A longer second slot leg 132 extends, from that an inner end, toward the first edge 126 and parallel to and spaced form the second edge 127. The first slot 130 is spaced from the first edge 126, thereby defining a radiating element. The second antenna 140 has a radiating element that is defined by an L-shaped second slot 136 with a short first leg 137 extending inwardly from and orthogonally to the third edge 128. A longer second slot leg 138 extends from the inner end of the first leg 137 spaced parallel from the third edge 128 and toward the first edge 126. The second slot 136 is spaced from the first edge 126 and provides a second radiating element.

The ground plane 125 extends around each of the first and second slots 130 and 136. A first signal port 142 has contacts on opposite sides of the first slot 130 near the end that is spaced from the ground plane's first edge 96. A second signal port 144 is similarly located with respect to the second slot 136.

The first and second antennas 134 and 140 are isolated from each other by a T-shaped isolation slot 145 which has a first leg 146 extending inwardly through the ground plane 125, perpendicular to the first edge 126 and terminating at an inner end. A second leg 148 extends orthogonally to the first leg 146 and is centered at the remote end of that first leg. Thus, the top of the T shaped isolation slot 145 is spaced inward from the first edge 126. The isolation slot 145 serves the same functions as the previous isolation slots in minimizing electromagnetic propagation from one radiating element to another.

Figure 6:
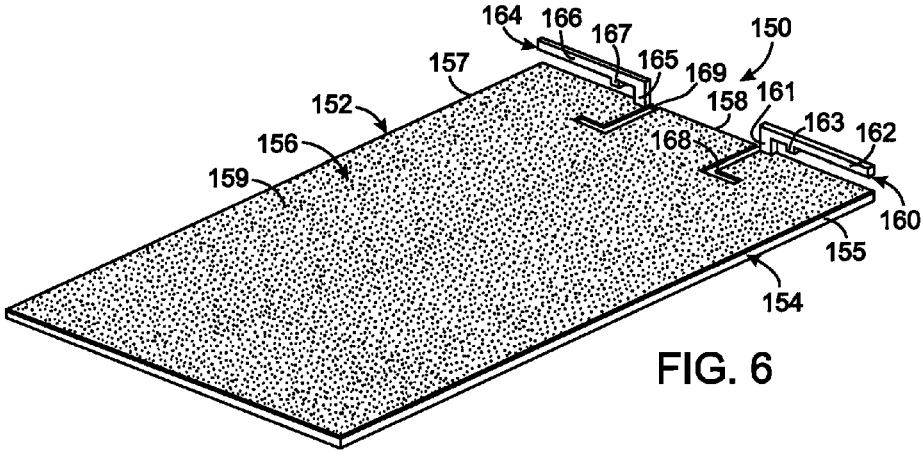
FIG. 6 is a perspective view of a printed circuit board from which antenna elements project in an orthogonal plane.

All the previously described slot antennas are coplanar with the ground plane on the printed circuit board and are formed by slots through that ground plane, such as by a conventional photolithographic etching process or by machining. FIG. 6 discloses an alternative embodiment of a fourth antenna assembly according to the present concepts. This fourth antenna assembly 150 is formed on a printed circuit board 152 that has a substrate 154 with a major surface. A layer 156 of conductive material is applied to the major surface of the dielectric substrate to form a ground plane 159, that has a first edge 158 and second and third edges 155 and 157 abutting the first edge.

The fourth antenna assembly 150 includes a first and second inverted F antennas (IFA) 160 and 164 spaced apart at the first edge 158 of the ground plane. A short conductive first support 161 is mechanically and electrically connected to the conductive layer 156 at the first edge 158 of the ground plane and projects away from the substrate, and forms a ground pin for the first inverted F antenna 160. A straight first arm 162 extends from an upper portion of the first support 161 parallel to and spaced from the first edge 158. A first signal pin 163 is spaced from the grounded first support 161 and is connected to the first arm 162 at one end and has a signal contact at the other end. The grounded first support 161, first signal pin 163, and the first arm 162 for the first inverted F antenna 160.

A short conductive second support 165 is mechanically and electrically connected to the conductive layer 156 at the first edge 158 of the ground plane and projecting away from the substrate and forming a ground pin for the second inverted F antenna 164. A straight second arm 166 extends from an upper portion of the second support 165 parallel to and spaced from the first edge 158 and terminates adjacent the third edge 157 of the ground plane. A second signal pin 167 is spaced from the ground pin 165 and is connected to arm 166 at one end and has a signal contact at the other end. The second ground pin support 165, second signal pin 167, and the second arm 166 form the second inverted F antenna 164. The first and second inverted F antennas 160 and 164 oppose each other across a width of the ground plane 159.

It should be understood that the two antennas on the same printed circuit board need not be of the same type. For example, one antenna may be a slot type, while the other may be an inverted F antenna.

The fourth antenna assembly 150 includes a pair of L-shaped isolation slots 168 and 169 in the conductive layer 156 forming the ground plane, which slots are similar to the isolation slots 74 and 76 described with respect to the third embodiment in FIG. 4. Specifically in FIG. 6, each isolation slot 168 and 169 has a long leg extending inward from the first edge 158 and then having a second shorter leg that projects from the interior end of the first leg toward the closest side edge 155 or 157, respectively.

Figure 7:
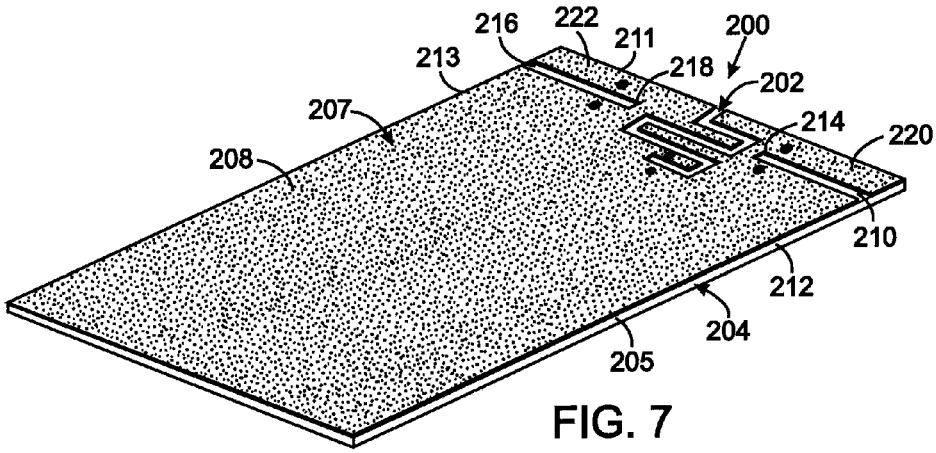
FIG. 7 is a perspective view of a printed circuit board on which a fifth embodiment of a multiple antenna arrangement.
Figure 8:
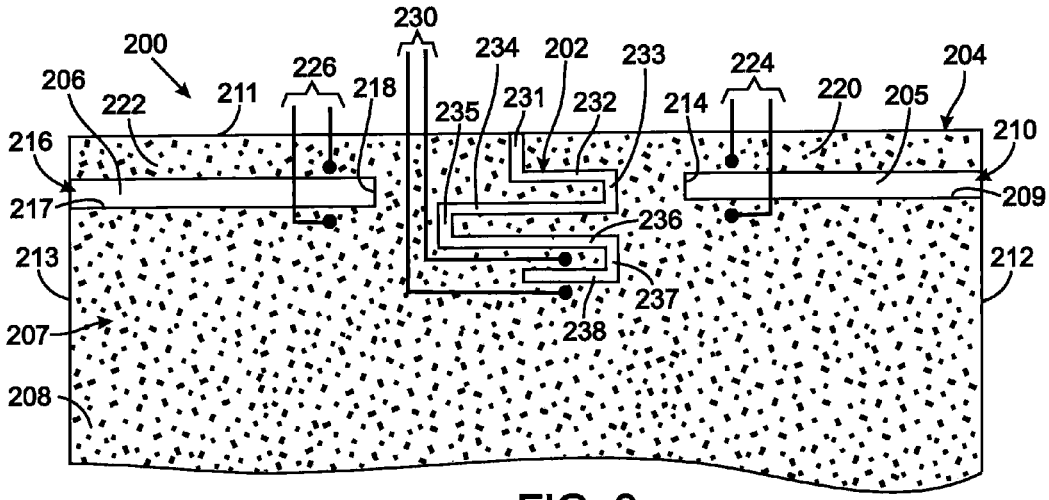
FIG. 8 is an enlarged view of a portion of the printed circuit board in FIG. 7.

With references to FIGS. 7 and 8, a fifth antenna assembly 200 is similar to the first antenna assembly 90 except that the meandering slot 202 has a third signal port which enables that slot to be excited and act as a radiating element with a specific resonance frequency, while at the same time acting as an isolation element between antennas 210 and 216 to reduce the coupling between the two antennas. The fifth antenna assembly 200 is formed on a printed circuit board 204 that has a dielectric substrate 205 with a major surface 206 on which an electrically conductive layer 207 is applied to form a ground plane 208. The ground plane has a first edge 211 and two side edges 212 and 213 that are orthogonal to the first edge. A first slot antenna 210 is formed by producing an open-ended first slot 209 entirely through the thickness of the conductive layer 207 and extending inwardly from the second edge 212 parallel to and spaced at some distance from the first edge 211. The first slot antenna 210 terminates at a closed inner end 214. Similarly a second slot antenna 216 is formed by a second slot 217 that extends inwardly from the third edge 213 parallel to and spaced from the first edge 211 and terminating at an inner end 218. Both the first and second slots 209 and 217 extend inward from opposing edges 212 and 213 of the ground plane 208 and longitudinally parallel to a common edge 211 of the ground plane and thus are aligned parallel to each other. The respective inner ends 214 and 218 of the two slots 209 and 217 are spaced apart by at least one-tenth of the smaller wavelength of the resonant frequency of the radiating elements. The first and second slot antennas 210 and 216 oppose each other across a width of the ground plane 208 and may have substantially identical shapes.

The ground plane 208 extends along three sides of the first and second slot antennas 210 and 216. A first conducting strip 220 and a second conducting strip 222 are formed between the first edge 211 and the open-ended slots of antennas 210 and 216 respectively. The width of the conducting strips 220 and 222 can be adjusted to optimize antenna resonant frequency and bandwidth.

A first signal port 224 is provided by two contacts on the ground plane 208 on opposite sides of the first slot antenna 210 near the inner end 214. A second signal port 226 is provided by other pair of contacts on the ground plane 208 on opposite sides of the second slot 217 near its inner end 218.

Alternatively the first and second slot antennas in FIGS. 7 and 8 may have the same construction as the radiating elements in FIGS. 4, 5, and 6. In an alternative configuration, the first and second slot antennas can be substituted with inverted F antenna as shown in FIG. 6, patch antenna, planar inverted F or other types of radiating elements.

A meandering slot 202 is located through the ground plane 208 between the first and second slot antennas 210 and 216 and preferably equidistantly between the inner ends 214 and 218 of the antennas. The meandering slot 202 is in the form of an isolating slot that has a serpentine pattern which meanders winding back and forth as a serpentine between the two slot antennas 210 and 216 as the meandering slot progresses inward from the first edge 211. The meandering slot is formed by a series of contiguous legs 231-238. Specifically, the meandering slot 202 has a first leg 231 that extends orthogonally inward from the substrate's first edge 211, and has an inner end from which a second leg 232 extends parallel to the first edge and toward the first slot antenna 210. The second leg 232 terminates at a first remote end that is away from the second slot antenna 216 and at a distance from the first slot antenna 210 and a third leg 233 projects at a right angle from the first remote end away from the first edge 211. The third leg 233 terminates at second remote end from which a fourth leg 234 extends parallel to the first edge 211 and toward the second slot antenna 216, terminating at a third remote end. A fifth leg 235 extends at a right angle from the third remote end of the fourth leg 234 and orthogonally away from the first edge 211. The fifth leg 235 terminates at a fourth remote end from which a sixth leg 236 extends parallel to and for the entire length of the fourth leg 234. The sixth leg 236 has a fifth remote end adjacent the inner end 214 of the first slot antenna 210. From the fifth remote end of the sixth leg 236, a seventh leg 237 projects farther inward orthogonally to the first edge 211 and terminates at a sixth remote end. An eighth leg 238 extends, from the sixth remote end, parallel to the first edge 211 and toward the second slot antenna 216. The eight legs 231-238 of the meandering slot 202 provide slot pattern that winds back and forth as a serpentine between the two antenna slots 209 and 217.

A third signal port 230 is provided by two contacts on the ground plane 208 on opposite sides of the eighth leg 238 of the meandering slot 202. A signal applied to the third signal port 230 may be in a different frequency band from the signals applied to the first and second signal ports 224 and 226. Alternatively, the signal applied to the third signal port 230 may be in the same frequency band of the signals applied to any of the first and second signal ports 224 and 226. The electrical length of the meandering slot 202, when acting as a radiating element, is approximately a quarter of a wavelength at the applied signal frequency. The meandering slot 202 can function as an independent antenna. In another application, the signal feed for the first and second slot antennas 210 and 216 can be turned on and off by the radio frequency circuit 28, so that any of those antennas can work as a two element MIMO antenna system along with the meandering slot 202.

Figure 9:
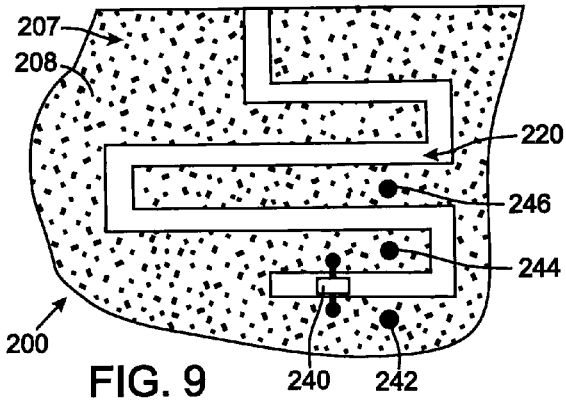
FIG. 9 is a variation of the fifth multiple antenna arrangement that has an element adjusts the antenna to different operating frequencies.

The resonant frequency of the fifth antenna assembly 200 can be dynamically tuned by changing the effective electrical length of the meandering slot 202. This may be accomplished, as depicted in FIG. 9 for example, by opening or closing one or more conductive bridges 240 across that slot. Each bridge 240 when activated by a solid state switch provides a conductive path across the meandering slot 202 thereby shortening the effective electrical length of the slot and the resonant frequency of the radiating element formed by that slot. In one implementation, plurality of at least three contacts 242, 244 and 246 are located on the fifth antenna assembly 200 and by selectively switching the signal feed to those contacts, different operating frequencies are obtained. The operating frequency of the meandering slot 202 also may be tuned to be the same as the resonant frequency of the linear first and second slot antennas 210 and 216.

Using a meandering slot radiator has the advantage of occupying less space on the printed circuit board 204 and also improves the bandwidth of the MIMO system.

When not excited, this meandering slot 202 provides electrical separation between the two slot antennas 210 and 216. The width and length of each leg and the number of legs of the serpentine meandering slot 202 can be varied to optimize the isolation (i.e., minimize mutual coupling) between the first and second slot antennas 210 and 216, as well as the operating bandwidth. For example, the seventh and eighth legs 237 and 238 can be omitted and the length of the sixth leg 236 shortened to be approximately equal to the length of the second leg 232, as in the embodiment shown in FIG. 10. In this configuration if port 230 is excited, signal coupling between slot antennas 210 and 216 improves at least by 3 db compared to when the meandering slot 202 is not excited. The first and second slot antennas 210 and 216 and the meandering slot 202 extend entirely through the thickness of the conductive layer exposing portions of the first major surface 206 of the printed circuit board substrate.

Figure 10:
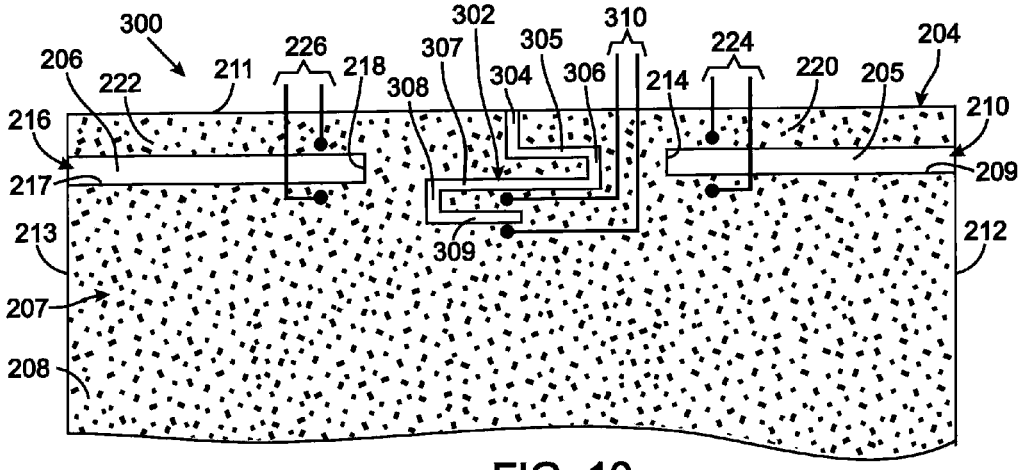
FIG. 10 is a plane view of a sixth version of a multiple antenna assembly is formed.

With reference to FIG. 10, a sixth antenna assembly 300 is similar to the fifth antenna assembly 200 in FIGS. 7 and 8, except for the configuration of the meandering slot 302. Therefore, like elements with respect to the previous antenna have been assigned identical reference numerals. Specifically the structure of the printed circuit board 204 is the same and has a dielectric substrate 205 with a conductive layer 207 on one major surface to form a ground plane 208. A two slot antennas 210 and 216 are formed on opposite sides of the ground plane.

The primary difference with respect to the sixth antenna assembly 300 is that the meandering slot 302 is symmetrical about a line that is perpendicular to the first edge 211 of the ground plane 208. Specifically, the meandering slot 302 has a first leg 304 that extends orthogonally inward from that first edge 211, and has an inner end from which a second leg 305 extends parallel to the first edge and toward the first slot antenna 210. The second leg 305 terminates at a first remote end away from the second slot antenna 216 and at a distance from the first slot antenna 210, and a third leg 306 projects at a right angle from the first remote end away from the first edge 211. The third leg 306 terminates at second remote end from which a fourth leg 307 extends parallel to the first edge 211 and toward the second slot antenna 216, terminating at a third remote end. A fifth leg 308 extends at a right angle from the third remote end of the fourth leg 307 and orthogonally away from the first edge 211. The fifth leg 308 terminates at a fourth remote end from which a sixth leg 309 extends parallel to the fourth leg 307. The length of the sixth leg 309 is equal to the length of the second leg 305, thus the sixth leg extends parallel along half the length of the fourth leg 307. Thus the meandering slot 302 is symmetrical about a longitudinal center line of the first leg 304.

A third signal port 310 is provided by two contacts on the ground plane 208 on opposite sides of the sixth leg 309 of the meandering slot 302. A signal applied to the third signal port 310 may be in a different frequency band from the signals applied to the first and second signal ports 224 and 226. Alternatively, the signal applied to the third signal port 310 may be in the same frequency band of the signals applied to any of the first and second signal ports 224 and 226. The electrical length of the meandering slot 302, when acting as a radiating element, is approximately a quarter of a wavelength at the applied signal frequency. The meandering slot 302 can function as an independent antenna. One or more conductive bridges 240 in the version in FIG. 9 also can be placed across slot 302 to selectively alter the effective electrical length and the resonant frequency of that slot. In another application, the signal feed for the first and second slot antennas 210 and 216 can be turned on and off by the radio frequency circuit 28, so that any of those antennas can work as a two element MIMO antenna system along with the meandering slot 302.

Figure 11:
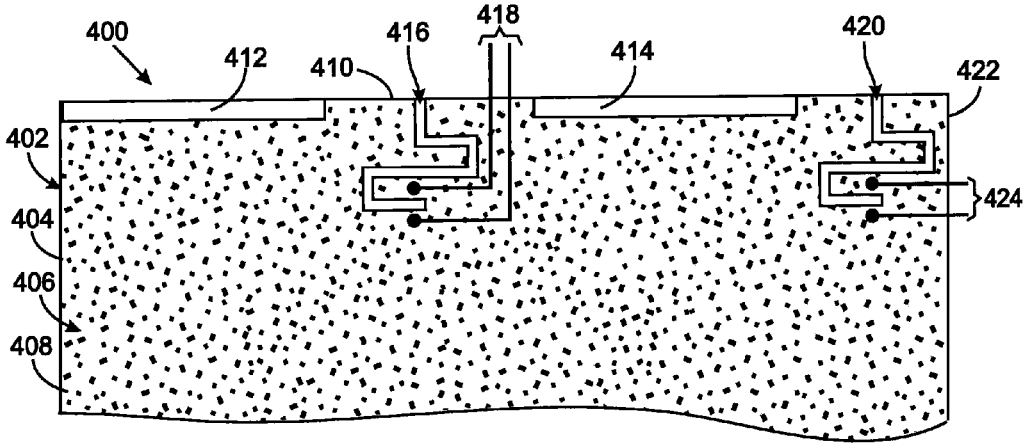
FIG. 11 is a plane view of a printed circuit board on which a seventh version of a multiple antenna assembly is formed.

In FIG. 11, a seventh antenna assembly 400 according to the present invention has a printed circuit board 402 with a dielectric substrate 404 on which a conductive pattern 406 is applied to form a ground plane 408. The ground plane has a first edge 410 along which first and second inverted F antennas 412 and 414 are located. These inverted F antennas 412 and 414 are similar in configuration to the two inverted F antennas 160 and 164 shown in FIG. 6. Specifically, each antenna 412 and 414 has a long arm which extends parallel to the first edge 410 of the printed circuit board 402 and also has a conductive support mechanically and electrically connected to the ground plane 408. Although not visible in the drawing, each of the first and second inverted F antennas 412 and 414 has a signal pin to which the respective electrical signal is applied to excite the antenna.

A first meandering slot 416, having the same symmetrical configuration as the meandering slot 302 described in FIG. 10, is located between the first and second antennas 412 and 414 extending inwardly from the first edge 410 into the ground plane 408. A first signal port 418 is provided by two contacts on the ground plane on opposite sides near the inward end of the first meandering slot 416.

A similar second meandering slot 420 is located in the ground plane 408 between the second antenna 414 and an edge 422 that is contiguous with and transverse to the first edge 410. The second meandering slot 420 extends inwardly from the first edge 410 and is symmetrical with respect to a line that is perpendicular to that edge and parallel to the second edge 422. A second signal port 424 is provided by two contacts on the ground plane 408 on opposite sides near the innermost end of the second meandering slot 420.

Although the first and second antennas 412 and 414 are depicted as inverted F antennas, they may comprise any other type of antennas commonly used in portable communication devices, such as a patch, a planer inverted F, or a monopole antenna.

Each of the four radiating elements 412, 414, 416, and 420 can be used at the same time or the signals applied to them can be independently disabled by switches operated by a controlling unit. The controlling and switching of the signals applied to these radiating elements can be performed based on the needs of the communication system thereby making that system reconfigurable. For example, any two of the four radiating elements 412, 414, 416, and 420 can be used together as a two element MIMO antenna system. Alternatively, the first and second antennas 412 and 414 may be excited at the same time or the two meandering slots 416 and 420 can be excited together. The again, the first antenna 412 and the first meandering slot 416 can be excited together or the second antenna 414 and the second meandering slot 420 can be used together. As a further variation, the effective length of the meandering slots can be varied to alter their operating frequency by conductive bridges or switches connected across the slot at different positions.

As a further alternative design, the L-shaped meandering slots 74 and 76 in the embodiment of FIG. 4 can also be excited by providing a pair of contacts on opposite sides adjacent the interior end of the slot. For example, the first meandering slot 74 has a first signal port 440 similarly located. In yet another variation, the T-shaped meandering slot 145 in FIG. 5 also can be excited by a signal port 450 formed by two contacts at opposite sides near one closed end of the T-shaped meandering slot.

The foregoing description was primarily directed to a certain embodiments of the antenna. Although some attention was given to various alternatives, it is anticipated that one skilled in the art will likely realize additional alternatives that are now apparent from the disclosure of these embodiments. Accordingly, the scope of the coverage should be determined from the following claims and not limited by the above disclosure.

The invention claimed is:

1. An antenna assembly for a wireless communication device comprising:

a dielectric substrate;

a ground plane supported by the dielectric substrate;

a first radiating element disposed on the substrate;

a first port coupled to the first radiating element for applying a first signal that excites the first radiating element;

a second radiating element disposed on the substrate and spaced apart from the first radiating element;

a second port coupled to the second radiating element for applying a second signal that excites the second radiating element;

a first meandering slot interposed on the ground plane between the first radiating element and the second radiating element wherein a start of the first meandering slot is at an edge of the ground plane and progresses inwardly from the edge in a region between the first radiating element and the second radiating element to provide isolation between the first radiating element and second radiating element; and a third port coupled to an end remote to the start of the first meandering slot for applying a third signal that excites the first meandering slot to operate as a third radiating element while providing said isolation between the first radiating element and second radiating element to reduce coupling between said first radiating element and second radiating element.

2. The antenna assembly as recited in claim 1 wherein the first and the second radiating elements have substantially identical shapes and oppose each other on the ground plane.

3. The antenna assembly of claim 1 wherein the first meandering slot is disposed at equal distances from the first and the second radiating elements.

4. The antenna assembly of claim 1 wherein the first and second radiating elements are selected from one of a slot antenna, inverted F antenna, planar inverted F antenna, patch antenna, and monopole antenna.

5. The antenna assembly of claim 1 wherein the ground plane comprises a layer of electrically conductive material disposed on a surface of the substrate.

6. The antenna assembly of claim 5 wherein the first radiating element and the second radiating element each comprise a slot in a form of an elongated opening in the layer of electrically conductive material, each slot extending inward from a different opposing edge of the ground plane and longitudinally parallel to a common edge of the ground plane.

7. The antenna assembly of claim 6 wherein the start of the first meandering slot is at the common edge of the ground plane.

8. The antenna assembly of claim 7 wherein the first meandering slot is symmetrical about a line that is orthogonal to the edge of the layer of electrically conductive material.

9. The antenna assembly of claim 5 wherein the first meandering slot extends through a thickness of the layer of electrically conductive material, and comprises a first leg that extends orthogonally inward from an edge of the layer of electrically conductive material and has an inner end, a second leg extending from the inner end parallel to the edge and toward the first radiating element terminating at a first remote end, a third leg projecting from the first remote end away from the edge until terminating at a second remote end, and a fourth leg extending from the second remote end parallel to the edge and toward the second radiating element until terminating at a third remote end.

10. The antenna assembly of claim 9 wherein the first meandering slot further comprises a fifth leg projecting from the third remote end away from the edge until terminating at a fourth remote end, and a sixth leg extending from the fourth remote end parallel to the edge and toward the first radiating element until terminating at a fifth remote end.

11. The antenna assembly of claim 10 wherein the first meandering slot further comprises a seventh leg projecting from the fifth remote end away from the edge until terminating at a sixth remote end, and an eighth leg extending from the sixth remote end parallel to the edge and toward the second radiating element.

12. The antenna assembly of claim 10 wherein the sixth leg of the first meandering slot has a length that is equal to a length of the second leg of the first meandering slot.

13. The antenna assembly of claim 5, wherein the first meandering slot extends through the layer of electrically conductive material and the remainder of the ground plane.

14. The antenna assembly of claim 1 further comprising:

a second meandering slot disposed on the ground plane; and a fourth port coupled to the second meandering slot for applying a fourth signal that excites the fourth meandering slot to act as a fourth radiating element.

15. The antenna assembly of claim 14 wherein the second meandering slot extends through a thickness of the ground plane, and comprises a first leg that extends orthogonally inward from an edge of the ground plane and has an inner end, a second leg extending from the inner end parallel to the edge and terminating at a first remote end, a third leg projecting from the first remote end away from the edge until terminating at a second remote end, a fourth leg extending from the second remote end parallel to the edge until terminating at a third remote end, a fifth leg projecting from the third remote end away from the edge until terminating at a fourth remote end, and a sixth leg extending from the fourth remote end parallel to the edge until terminating at a fifth remote end.

16. The antenna assembly of claim 15 wherein the a sixth leg of the second meandering slot has a length that is equal to a length of the second leg of the second meandering slot.

17. The antenna assembly of claim 16, wherein the dielectric substrate is on a printed circuit board.

18. The antenna assembly of claim 1 further comprising a bridge which can be selectively activated to provide a conductive path across the first meandering slot.

19. The antenna assembly of claim 1 wherein the third port comprises at least three contacts and applying the third signal to different ones of the contacts causes the first meandering slot to operate at different frequencies.

20. The antenna assembly of claim 1, wherein the first meandering slot extends through the entire thickness of the ground plane.

21. The antenna assembly of claim 1, wherein the dielectric substrate is on a printed circuit board.

22. An antenna assembly for a wireless communication device comprising:

a nonconductive material substrate and a ground plane, the ground plane formed by a layer of electrically conductive material disposed on the substrate, wherein the layer of electrically conductive material has a thickness;

a first slot antenna formed by a first radiation slot extending through the thickness of the layer of electrically conductive material;

a second slot antenna formed by a second radiation slot extending through the thickness of the layer of electrically conductive material and spaced from the first slot antenna;

a first meandering slot extending through the thickness of the layer of electrically conductive material and located between the first slot antenna and the second slot antenna, wherein the first meandering slot starts at an edge of the layer of electrically conductive material and continues inward in a meandered pattern;

a first signal port coupled to the first slot antenna; and a second signal port coupled to the second slot antenna; and a third signal port coupled to the first meandering slot.

23. The antenna assembly of claim 22 wherein the first radiation slot is linear; and the second radiation slot is linear and aligned parallel to the first radiation slot.

24. The antenna assembly as recited in claim 22 wherein the first and the second radiation slots have substantially identical shapes and oppose each other across the ground plane.

25. The antenna assembly of claim 22 wherein the first meandering slot is disposed at equal distances from the first and the second radiation slots.

26. The antenna assembly of claim 22 wherein the first meandering slot comprises a plurality of contiguous legs arranged in a serpentine pattern.

27. The antenna assembly of claim 22 wherein the first meandering slot is symmetrical about a line that is orthogonal to the edge of the layer of electrically conductive material.

28. The antenna assembly of claim 22 further comprising:

a second meandering slot disposed on the ground plane; and a fourth port coupled to the second meandering slot for applying a fourth signal that excites the fourth meandering slot to act as a fourth radiating element.

29. The antenna assembly of claim 22, wherein the dielectric substrate is on a printed circuit board.

* * * * *